US010631692B1

(12) United States Patent
Guirlinger

(10) Patent No.: US 10,631,692 B1
(45) Date of Patent: Apr. 28, 2020

(54) PLUNGER COVER

(71) Applicant: Edward G. Guirlinger, New Albany, OH (US)

(72) Inventor: Edward G. Guirlinger, New Albany, OH (US)

( * ) Notice: Subject to any disclaimer, the term of this patent is extended or adjusted under 35 U.S.C. 154(b) by 0 days.

(21) Appl. No.: 15/915,128

(22) Filed: Mar. 8, 2018

(51) Int. Cl.
*A47K 17/00* (2006.01)
*E03D 9/00* (2006.01)

(52) U.S. Cl.
CPC ..... *A47K 17/00* (2013.01); *E03D 9/00* (2013.01)

(58) Field of Classification Search
CPC ..... A47K 17/00
USPC ..... 4/255.11
See application file for complete search history.

(56) References Cited

U.S. PATENT DOCUMENTS 5,335,374 A * 8/1994 Wilk ..... B65D 81/36 4/255.11
5,924,566 A * 7/1999 Gibbs ..... B65D 43/163 206/15.3
2002/0100705 A1* 8/2002 Phillips ..... A47K 11/10 206/349

* cited by examiner

*Primary Examiner* — Lauren A Crane
(74) *Attorney, Agent, or Firm* — Robert R. Lech; Lech Law, LLC

(57) ABSTRACT

The plunger cover of the present application comprises a plurality of enclosure elements and a handle. In one embodiment, the plunger cover comprises two enclosure elements connected by an integrated hinge. The enclosure elements are movable between an open configuration and a closed configuration, and they may be retained in the closed configuration by a retaining mechanism, such as a latch.

16 Claims, 9 Drawing Sheets

PLUNGER COVER

TECHNICAL FIELD

The present application generally relates to devices for covering a plunger. More specifically, the present application relates to a plunger cover having certain advantageous features.

BACKGROUND

Maintenance personnel often use plungers to unclog sinks, drains and toilets. Plunger holders are well known for storing plungers in areas of frequent use, such as near a faulty toilet or drain, but such holders are not designed or desirable to contain a plunger during transport from one location to another. Some utility bags exist for storing and transporting plungers, but such bags have certain shortcomings. One shortcoming is that they are designed to encase an entire plunger. A second shortcoming is that residual material collected by the cup and flange of the plunger is placed into such bags along with the plunger, and such residual material can be transferred to the handle during transport.

A need therefore exists for a plunger cover which can cover primarily the cup and flange of a plunger during transport. Additionally, a need exists for plunger cover with an integrated handle to assist in transportation.

SUMMARY

According to a first aspect of the present application, an example plunger cover is disclosed. The example plunger cover comprises: A plunger cover for at least partially encasing a cup and flange of a plunger. The plunger cover comprises: a plurality of enclosure elements; a retaining mechanism; and a handle. Each enclosure element cooperates with at least one other enclosure element. The plurality of enclosure elements are operable in an open configuration and a closed configuration. In the open configuration, the plurality of enclosure elements are disposed to receive the cup and the flange of the plunger, and in the closed configuration the plurality of enclosure elements are disposed to substantially enclose the cup and the flange of the plunger. The retaining mechanism is configured to fasten one enclosure element to another enclosure element in the closed configuration; and According to a second aspect of the present application, an example plunger cover is disclosed. The example plunger cover comprises: two enclosure elements; a hinge connecting the two enclosure elements; and a handle. The two enclosure elements are hingedly moveable between an open configuration and a closed configuration. In the open configuration, the enclosure elements are disposed to receive the cup and the flange of the plunger, and in the closed configuration, the enclosure elements are disposed to substantially enclose the cup and the flange of the plunger.

According to a third aspect of the present application, an example plunger cover is disclosed. The example plunger cover comprises: two enclosure elements; an integrated hinge disposed between and connecting the two enclosure elements; a retaining mechanism formed by the two enclosure elements, and a handle formed by the two enclosure elements. The retaining mechanism comprises a latch, and the two enclosure elements are rotatable about the hinge between an open configuration and a closed configuration. In the open configuration, the enclosure elements are disposed to receive the cup and the flange of the plunger, and in the closed configuration, the enclosure elements are disposed to substantially enclose the cup and the flange of the plunger.

BRIEF DESCRIPTION OF THE DRAWINGS

The accompanying figures, which are incorporated in and constitute a part of the specification, illustrate various example apparatuses, systems, methods, and so on, and are used merely to illustrate various example embodiments. It should be noted that various components depicted in the figures may not be drawn to scale, and that the various assemblies and designs depicted in the figures are presented for purposes of illustration only, and should not be considered in any way as limiting.

DRAWING REFERENCE NUMERALS

Figure 1:
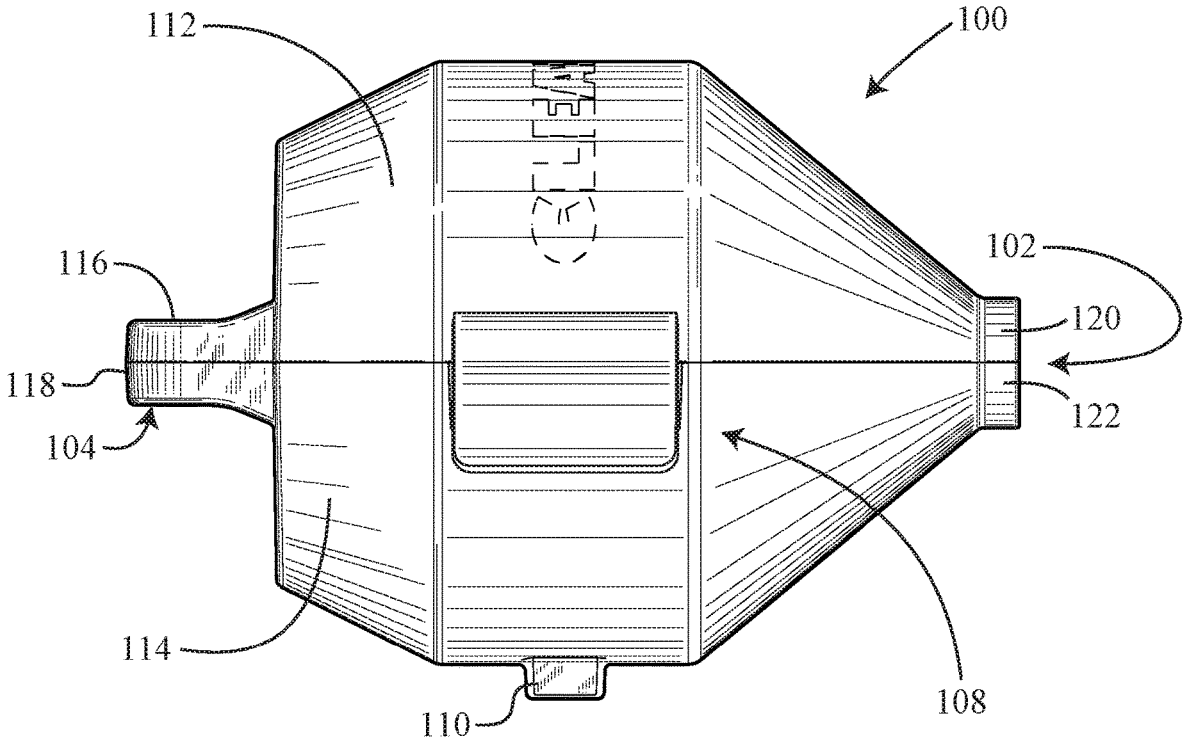
FIG. 1 is a left side elevational view of a plunger cover.
Figure 2:
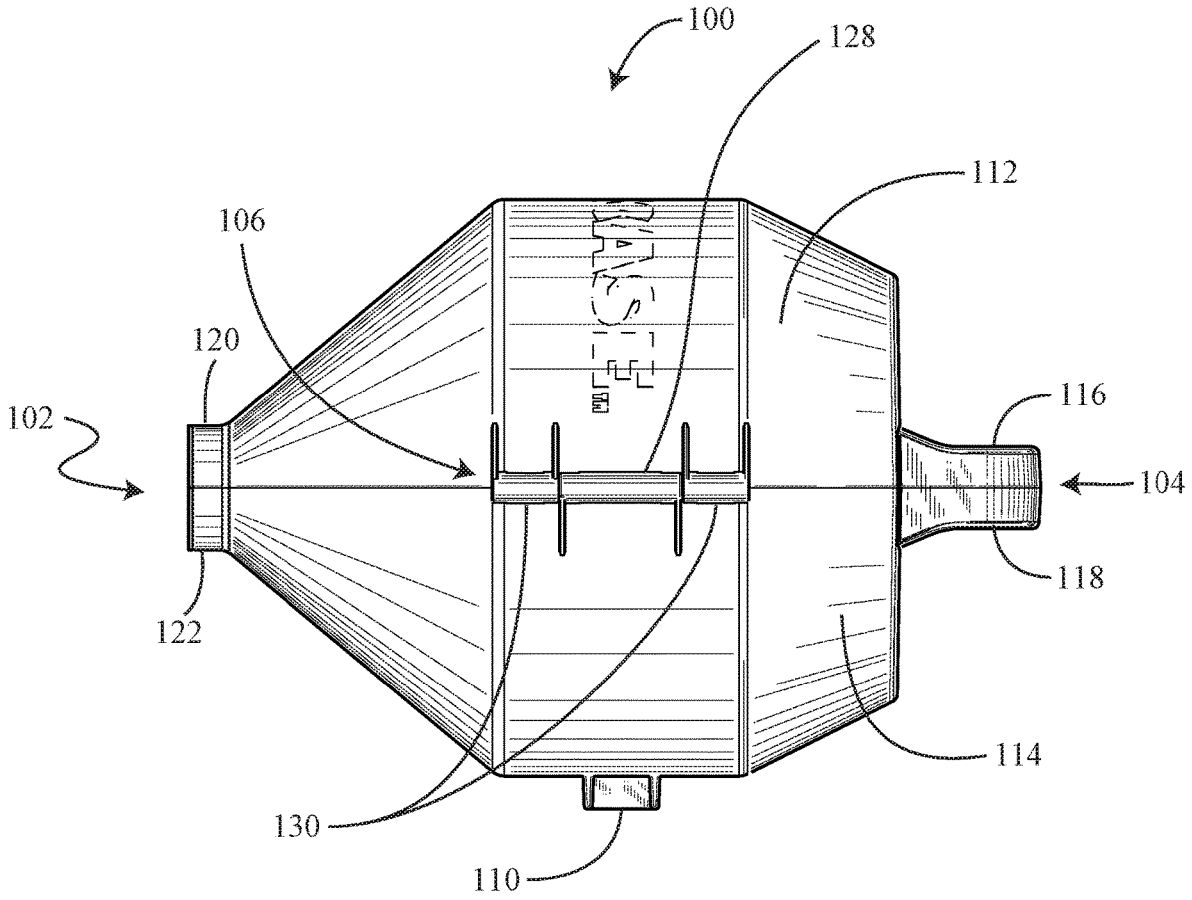
FIG. 2 is a right side elevational view of the plunger cover of FIG. 1.
Figure 3:
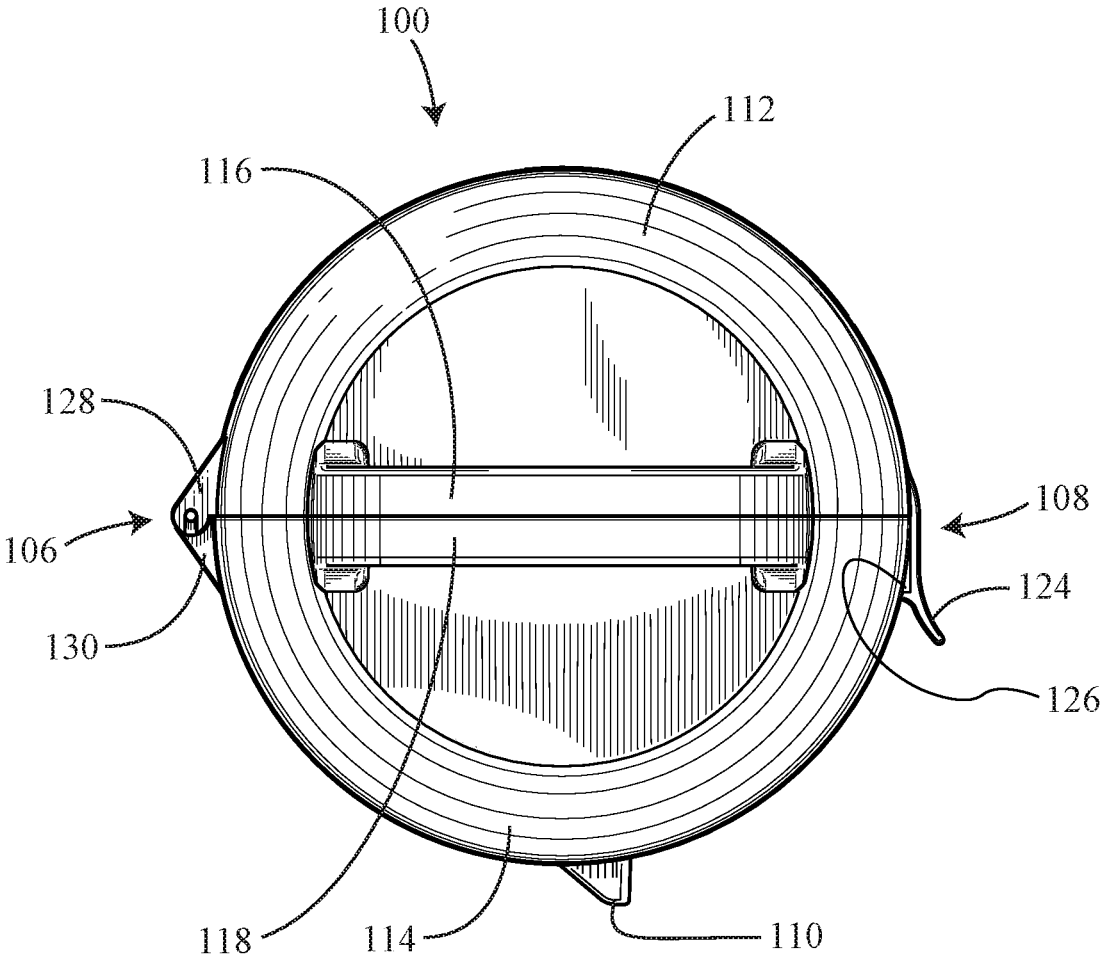
FIG. 3 is a top plan view of the plunger cover of FIG. 1.
Figure 4:
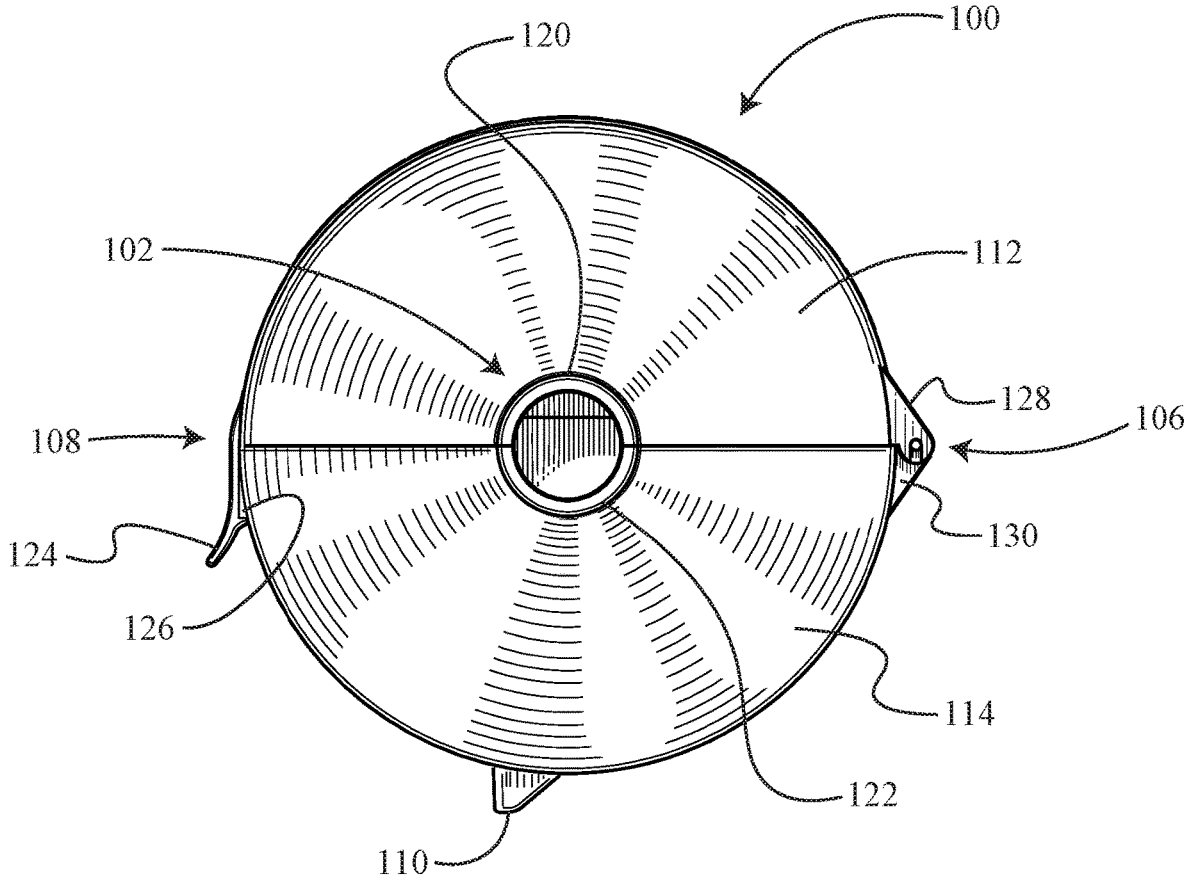
FIG. 4 is a bottom plan view of the plunger cover of FIG. 1.
Figure 5:
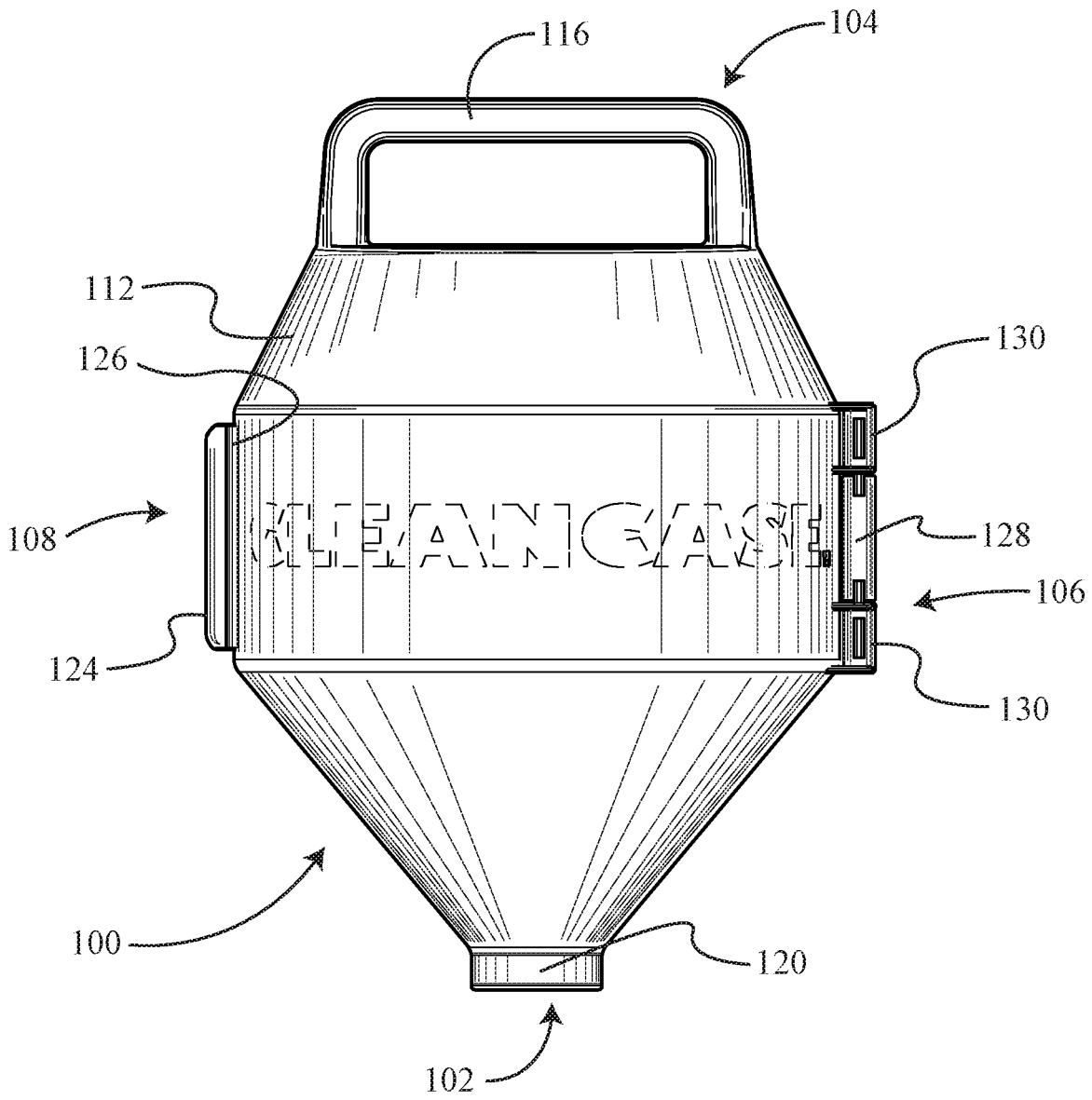
FIG. 5 is a front elevational view of the plunger cover of FIG. 1.
Figure 6:
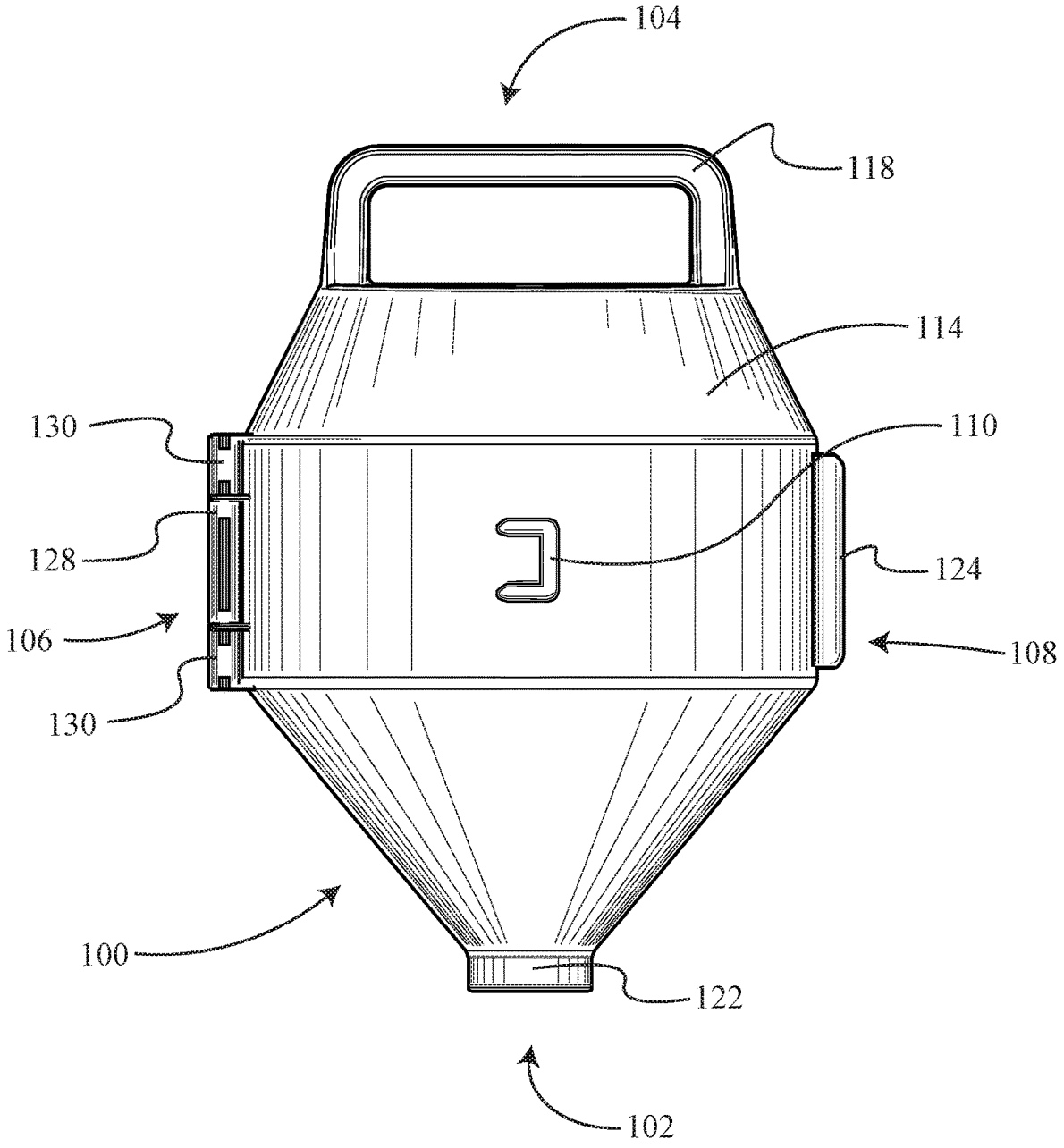
FIG. 6 is a rear elevational view of the plunger cover of FIG. 1.

The following reference characters identify the associated elements depicted in the drawings describing the present invention:

| | |
|---|---|
| 100 | Cover |
| 102 | Collar |
| 104 | Handle |
| 106 | Hinge |
| 108 | Retaining Mechanism |
| 110 | Pressure Element |
| 112 | First Enclosure Element |
| 114 | Second Enclosure Element |
| 116 | First Handle Portion |
| 118 | Second Handle Portion |
| 120 | First Collar Portion |
| 122 | Second Collar Portion |
| 124 | First Latch Element |
| 126 | Second Latch Element |
| 128 | First Hinge Portion |
| 130 | Second Hinge Portion |
| 150 | Plunger |
| 152 | Plunger Handle |
| 154 | Plunger Cup |
| 156 | Plunger Flange |

DETAILED DESCRIPTION

FIGS. 1-9 illustrate various aspects of an example plunger cover 100. As shown in FIGS. 1-7, example plunger cover 100 comprises following elements: a collar 102, a handle 104, a hinge 106, a retaining mechanism 108, and a pressure element 110. In FIGS. 1-7, cover 100 is shown in a closed configuration which is conducive for transporting a plunger 150 from location to location. The various elements of cover 100 are discussed in greater detail below.

Figure 7:
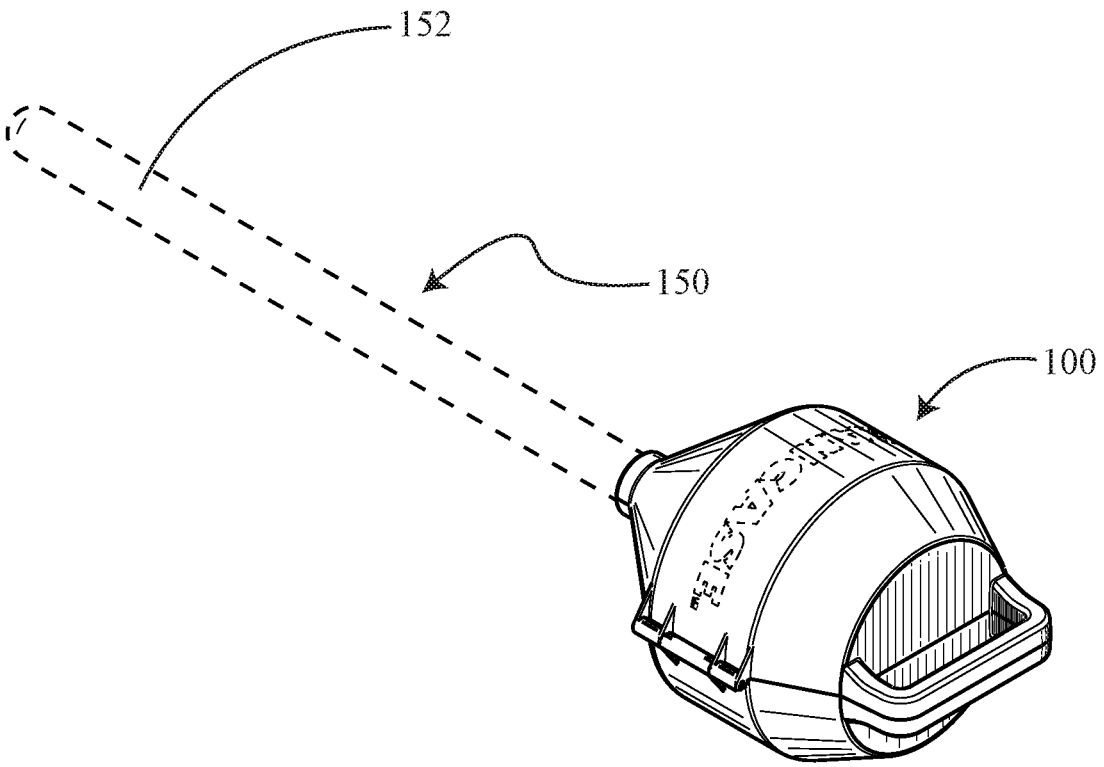
FIG. 7 is a perspective, environmental view of the plunger cover of FIG. 1 in a closed configuration.

FIG. 7 depicts the plunger cover in use with respect to plunger 150. Plunger 150 is a typical plunger comprising a handle 152, a cup 154 and a flange 156. As shown, when in the closed configuration, plunger cover 100 defines a central axis that coincides with a longitudinal axis of plunger 150.

Figure 8:
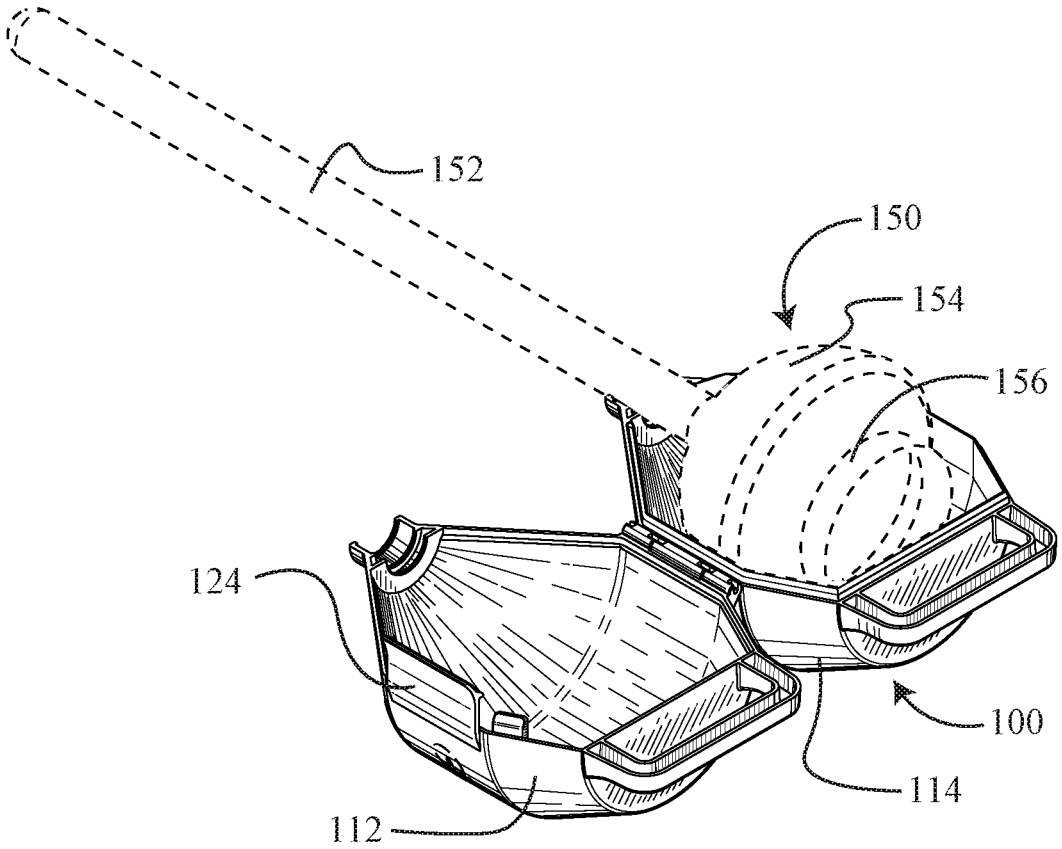
FIG. 8 is a perspective, environmental view of the plunger cover of FIG. 1 in an open configuration.
Figure 9:
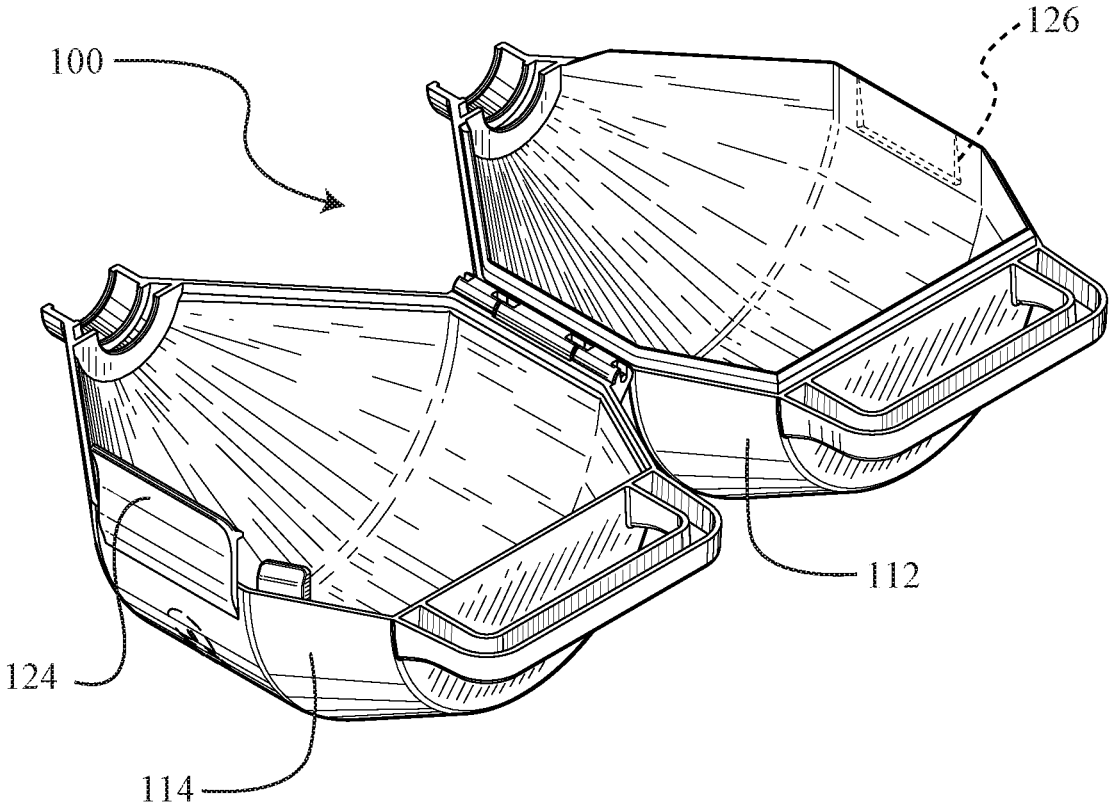
FIG. 9 is a perspective view of the plunger cover of FIG. 1 in an open configuration.

As shown in FIGS. 8 and 9, cover 100 may also be disposed in an open configuration. Using the open configuration, a user may insert a plunger 150 into, and remove plunger 150 from, cover 100. In the open configuration, cover 100 comprises a first enclosure portion 112 and a second enclosure portion 114, which cooperate with one another when cover 100 is disposed in the closed configuration to substantially enclose a cup 154 and a flange 156 of the plunger 150.

Cover 100 further comprises a first handle portion 116 and a second handle portion 118, which cooperate with one another when cover 100 is disposed in the closed configuration to form handle 104. Similarly, cover 100 still further comprises a first collar portion 120 and a second collar portion 122, which cooperate with one another when cover 100 is disposed in the closed configuration to form collar 102.

First enclosure portion 112 and second enclosure portion 114 rotate with respect to one another about an axis defined by hinge 106. Hinge 106 comprises a first hinge portion 128 and a second hinge portion 130. Once the first enclosure portion 112 and the second enclosure portion 114 are positioned in the closed configuration of FIG. 2, retaining mechanism 108 secures them with respect to one another.

Retaining mechanism 108 comprises a first latch element 124 and a second latch element 126 which cooperate with one another in the closed configuration. In the illustrated example embodiment, first latch element 124 is a hasp and second latch element 126 receives and retains the hasp. Pressure element 110 enables a user to maintain a solid grasp on the device, as well as provide leverage for operating the first latch element 124 of the retaining mechanism 108. One of ordinary skill in the art will appreciate various alternative retaining mechanisms which are satisfactory for securing the two enclosure portions 114 and 116 to one another in the closed configuration.

Furthermore, while the devices, systems, methods, and so on have been illustrated by describing examples, and while the examples have been described in considerable detail, it is not the intention of the applicant to restrict, or in any way, limit the scope of the appended claims to such detail. It is, of course, not possible to describe every conceivable combination of components or methodologies for purposes of describing the devices, systems, methods, and so on provided herein. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2d. Ed. 1995).

What is claimed is:

1. A plunger cover comprising:

a plurality of enclosure elements, each enclosure element cooperating with at least one other enclosure element, each of the plurality of enclosure elements comprising a handle portion, the plurality of enclosure elements operable in an open configuration and a closed configuration, in the open configuration the plurality of enclosure elements are disposed to receive a cup and a flange of a plunger, and in the closed configuration the plurality of enclosure elements define a cavity substantially enclosing the cup and the flange of the plunger, the cavity comprising an outer surface, in the closed configuration the plurality of enclosure elements further define an aperture through which a handle of the plunger extends;

a retaining mechanism configured to fasten one enclosure element to another enclosure element in the closed configuration; and a cover handle formed by the plurality of handle portions when the plunger cover is disposed in the closed configuration, the cover handle disposed external to the outer surface of the cavity and proximal to the bottom surface of the enclosed flange.

2. The plunger cover of claim 1 wherein the plurality of enclosure elements cooperate in the closed configuration to form a collar.

3. The plunger cover of claim 1 wherein:

in the closed configuration, the plunger cover defines: a generally central axis, a first axial end disposed in proximity to the handle of the plunger, and a second axial end disposed in proximity to the flange of the plunger; and the second axial end is substantially closed.

4. The plunger cover of claim 1 wherein the plurality of enclosure elements comprises not more than two enclosure elements.

5. The plunger cover of claim 1 wherein the plurality of enclosure elements form a clamshell design.

6. The plunger of claim 1 wherein the plurality of enclosure elements are connected by at least one hinge.

7. The plunger cover of claim 1 wherein the retaining mechanism comprises a latch.

8. A plunger cover comprising:

two enclosure elements, each enclosure element comprising a handle portion, the two enclosure elements are hingedly moveable between an open configuration and a closed configuration;

a hinge connecting the two enclosure elements; and a cover handle formed by the two handle portions when the plunger cover is disposed in the closed configuration;

wherein in the open configuration the enclosure elements are disposed to receive a cup and a flange of a plunger, and in the closed configuration the enclosure elements define a cavity substantially enclosing the cup and the flange of the plunger, the cavity comprising an outer surface and the cover handle is disposed external to the outer surface of the cavity and proximal to the bottom surface of the enclosed flange, in the closed configuration the two enclosure elements further define an aperture through which a handle of the plunger extends.

9. The plunger cover of claim 8 further comprising a retaining mechanism, the retaining mechanism configured to maintain the plunger cover in the closed configuration.

10. The plunger cover of claim 8 wherein the retaining mechanism comprises a latch.

11. The plunger cover of claim 8 wherein the enclosure elements cooperate in the closed configuration to form a collar.

12. The plunger cover of claim 8 wherein the two enclosure elements and the hinge are molded to form a single element.

13. A plunger cover comprising:

two enclosure elements, each of the plurality of enclosure elements comprising a handle portion;

an integrated hinge disposed between and connecting the two enclosure elements;

a retaining mechanism formed by the two enclosure elements, the retaining mechanism comprising a latch and a cover handle formed by the plurality of handle portions when the plunger cover is disposed in a closed configuration;

wherein the two enclosure elements are rotatable about the hinge between an open configuration and the closed configuration, in the open configuration the enclosure elements are disposed to receive a cup and a flange of a plunger, and in the closed configuration the enclosure elements define a cavity substantially enclosing the cup and the flange of the plunger, the cavity comprising an outer surface, in the closed configuration the plurality of enclosure elements further define an aperture through which a handle of the plunger extends, the cover handle disposed external to the outer surface of the cavity and proximal to the bottom surface of the enclosed flange.

14. The plunger cover of claim 1 further comprising a pressure element formed on the outer surface of one enclosure element.

15. The plunger cover of claim 8 further comprising a pressure element formed on the outer surface of one enclosure element.

16. The plunger cover of claim 13 further comprising a pressure element formed on the outer surface of one enclosure element.

* * * * *